United States Patent [19]

Giovanni

[11] Patent Number: 4,509,576

[45] Date of Patent: Apr. 9, 1985

[54] SUNSHADE FITTING CONVERTIBLE INTO VERANDA CURTAIN FITTING

[76] Inventor: Serafini Giovanni, via Fiocchetto 33, 10152 Turin, Italy

[21] Appl. No.: 544,609

[22] Filed: Oct. 24, 1983

[30] Foreign Application Priority Data

Nov. 9, 1982 [IT] Italy ..... 68310 A/82

[51] Int. Cl.[3] ..... E04F 10/06

[52] U.S. Cl. ..... 160/66

[58] Field of Search ..... 160/45, 66, 67, 68, 160/52, 245, 246–248

[56] References Cited

U.S. PATENT DOCUMENTS

| | | | |
|---|---|---|---|
| 1,080,910 | 12/1913 | Martshorn | 160/67 |
| 1,081,042 | 12/1913 | Hartshorn | 160/67 |
| 2,269,350 | 1/1942 | Williams | 160/67 |
| 3,807,481 | 3/1974 | Weider et al. | 160/45 |

*Primary Examiner*—Peter M. Caun

[57] ABSTRACT

A sunshade fitting convertible into a veranda curtain fitting comprises a fixed grooved column on which a likewise grooved curtain supporting arm is pivotally mounted, the pivot means of these two elements being formed by a fixed member firmly secured to the column, projecting circumferentially therefrom and provided with a series of notches, and a jaw member firmly secured to the curtain supporting arm and rotatably fitting the fixed member, the relative position of the two members and thus of the arm and column being adjustable by means of a pin firmly secured to the arm. A pair of lateral grooves is provided on the pivot means to form two paths of movement, one along the column for the veranda position and the other along the arm for the sunshade position, for upward and downward movement of the curtain supporting roller. At the lower ends of the paths of movement of both the column and the movable arm there is provided a locking labyrinth for fixing the curtain.

3 Claims, 6 Drawing Figures

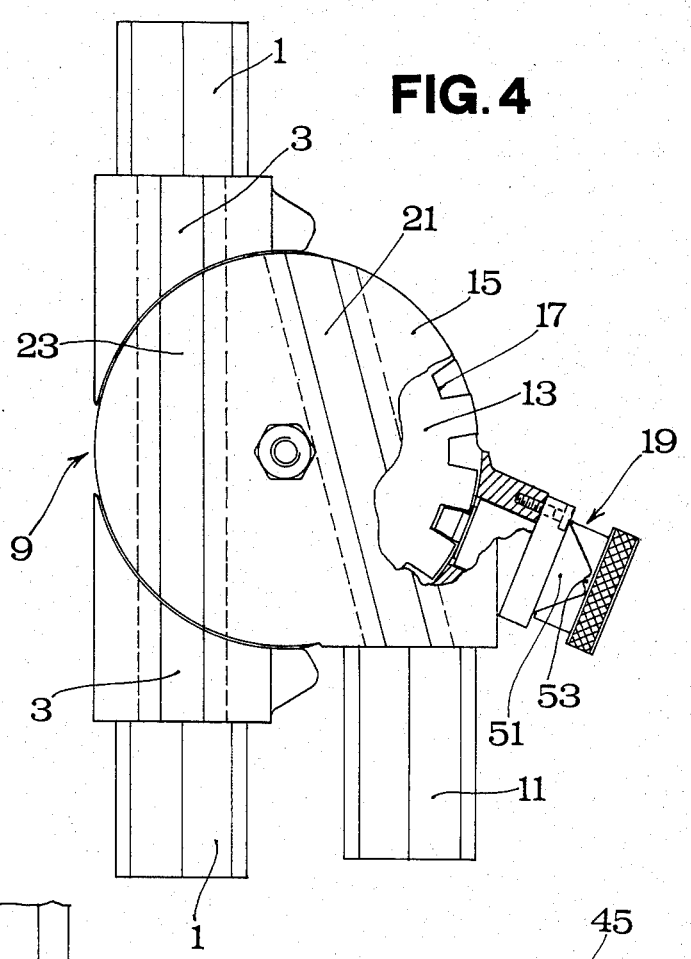
FIG. 4
FIG. 5
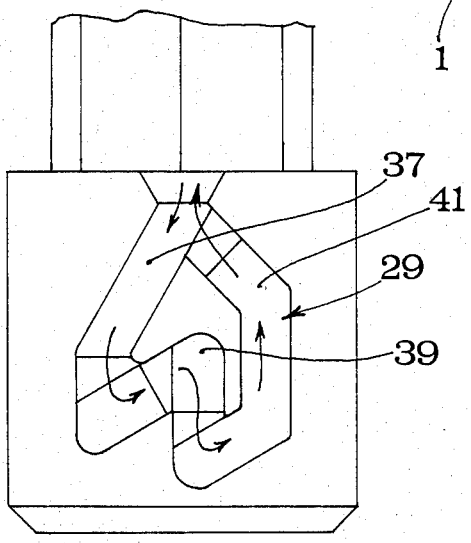
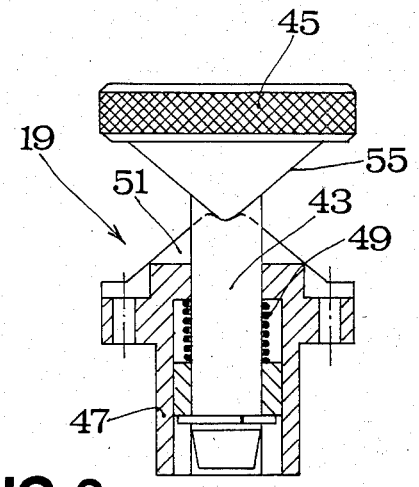
FIG. 6

SUNSHADE FITTING CONVERTIBLE INTO VERANDA CURTAIN FITTING

BACKGROUND OF THE INVENTION

This invention relates to a sunshade fitting that can be converted into a veranda curtain fitting.

As is known, conventional sunshade fittings must meet more and more ample and severe requirements because of the variety of types of curtains which modern designs and their environments require. Each of these types of curtains must meet definite requirements with regard to solidity and safety in addition to the primary purely formal and aesthetical requirements. In other words, present curtain fittings must be of a very precise, calculated and functional design without leaving anything or little to improvisation or approximation. This is why the fittings for curtains of the various types accomplish their functions for the type of curtain for which they are designed and on the market there will hardly be a type of fitting which accomplishes more than one function.

It is an object of the curtain fitting of the present invention to eliminate this drawback by providing a curtain fitting which rationally and practically accomplishes two fundamental functions of curtain types, that of the sunshade and that of the veranda curtain.

SUMMARY OF THE INVENTION

The curtain fitting according to the present invention substantially comprises:

a supporting column made of an appropriately longitudinally grooved sectional member secured to the ceiling and floor of the terrace to which the curtain is to be applied, each of said columns being provided with an upper link member for connection to the ceiling by means of a plate with dowels and bolts, and a lower link member having an adjustable foot supported on the floor;

an arm forming a single body with the supporting column, but pivotally mounted relative thereto, to pivot about a centre of rotation located at a suitable height in the vicinity of the middle or the medium third of said column;

a pivot means provided adjacent said arm for rotation in an appropriate seat and adapted to regulate by said rotation the height of the curtain supporting arm secured thereto, said pivot means being formed by coupling two members one of which is flat and firmly secured to the column and has a substantially circular profile projecting outwardly from said column and the other is firmly secured to said arm and fits said first member in the manner of a jaw and is adapted to rotate relative thereto, said first member being provided with a series of notches appropriately spaced along the periphery of said circular profile and defining the pitch of inclination of said movable arm, said second member being provided with a stop pin adapted to selectively engage one of said notches and being urged radially thereinto by spring means;

said pivot member firmly secured to said arm being laterally provided with at least two grooves adapted to be aligned alternately with a longitudinal groove provided laterally on said column, one groove forming a slideway for a curtain supporting lower end rod, when the curtain is to be extended along said arm in the sunshade position and the other groove forming a slideway for said curtain supporting lower end rod when said rod is to be moved downwardly to the end of said longitudinal groove in said column in the veranda curtain position;

said grooves in said column and arm being provided at their ends with a labyrinth locking track for locking the drawn curtain in position and facilitating its extraction for lifting;

said curtain supporting lower end rod being provided at its two ends with a lever member freely pivotally mounted on an appropriate pivot on the axis of said rod and adapted to move along said grooves in said column and arm, said pivot supporting at its free end another pivot adapted to move along said labyrinth track, the movability of said pivot arranged at the free end of said lever member permitting said curtain supporting lower end rod to be locked and unlocked for lowering and lifting the curtain.

Said stop pin for locking said pivot means may conveniently be accommodated in an appropriate seat firmly secured to said arm, said stop pin having a point and an end opposite said point provided with a knurled head and a portion tapering conically toward said point, a dihedral seat on said stop pin for receiving said conical portion when said stop pin is depressed, said dihedral seat terminating upwardly with a triangular recess arranged perpendicularly to the axis of said dihedron and adapted to receive said conically tapering portion of said knurled head of said stop pin when it is rotated through 90° relative to its locking position.

The sunshade fitting according to the present invention advantageously comprises at least three rollers including a first curtain winder roller firmly secured to said supporting column in the vicinity of an upper end thereof, a curtain winder and supporting end roller secured to a free end of said curtain and forming a stiffening and locking element necessary for stably fixing said curtain in the veranda and sunshade positions, and a third idle roller slidably secured in the vicinity and above said pivot means of the arm in said slideway grooves of said supporting column, said third idle roller being arranged to lower to a position above said pivot means of said arm when said curtain is lowered and to be lifted from said position when said curtain is lifted by said curtain winder and supporting end roller.

BRIEF DESCRIPTION OF THE DRAWINGS

FIG. 4 is a part sectional enlarged view of the pivot means for pivotally mounting the arm to the supporting column;

FIG. 5 is a detailed and enlarged side view of the locking labyrinth track provided at the bottom of the supporting column and arm;

FIG. 6 is a part sectional detailed view of the locking device of the pivot means in the open position.

DESCRIPTION OF PREFERRED EMBODIMENT

Figure 1:
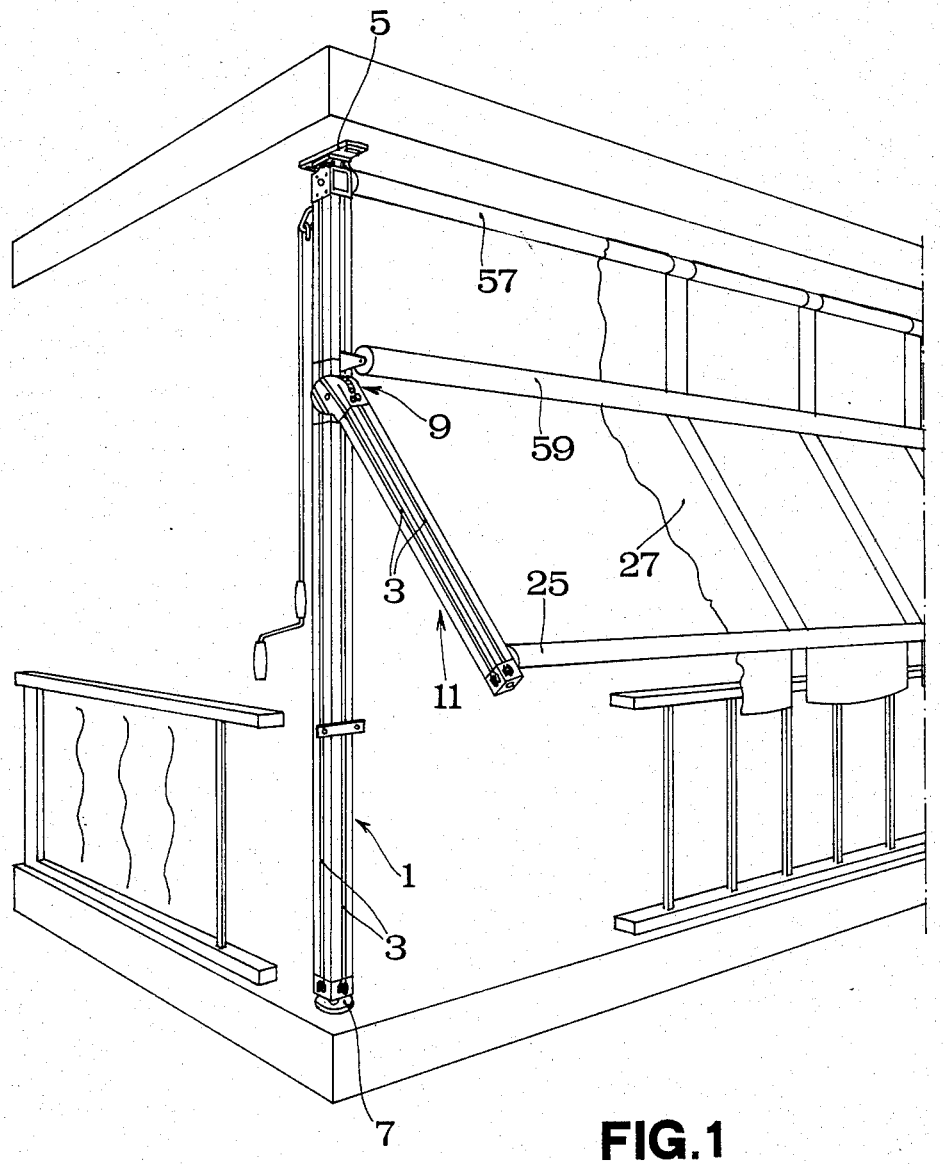
FIG. 1 is a perspective view of a curtain and sunshade fitting according to the invention in the "sunshade" position.

Referring to FIG. 1, a sunshade fitting according to the invention substantially comprises a supporting column 1 made of a sectional member secured to a ceiling and floor of the terrace to which the curtain is to be applied by known means. More particularly, for connection to the ceiling an appropriate plate 5 is provided that can be secured to the ceiling by dowels and bolts, whereas for connection to the floor an appropriate pressure-adjustable foot 7 is provided. The supporting column 1 is provided laterally and in the front surface thereof with a longitudinal groove 3. Pivotally mounted by pivot means 9 on the supporting column 1 is an arm 11 which forms a single body with the supporting column 1, the arm 11 supporting the curtain in its "sunshade" position. The pivotally mounted arm 11 is likewise made of a longitudinally grooved sectional member similar to the sectional member of the supporting column 1 and its center of rotation is arranged in the middle or the medium third of the height of column 1. The arm 11 likewise has a lateral longitudinal groove 3 and a front longitudinal groove 3.

As shown in FIG. 4, the pivot means 9 for pivotal connection of the arm 11 to the column 1 comprises a pair of mutually coupled members 13 and 15 the first one 13 of which is flat and firmly secured to the column 1 and has a substantially circular profile projecting outwardly from the column 1, whereas the other member 15 is firmly secured to the arm 11 and formed by a jaw member fitting the first member 13 and adapted to rotate relative thereto. The first member 13 is provided with a series of notches 17 appropriately spaced along the periphery of the circular profile of member 13 to define the pitch of inclination of the movable arm 11. The second member 15 is provided rearwardly with an appropriate stop pin 19 adapted to selectively engage in one or the other of the notches 17 under the action of appropriate spring means, as will be described in detail hereinafter.

The pivot member 15 that is firmly secured to the arm 11 is laterally provided with at least two grooves 21 and 23 adapted to be aligned alternately with the lateral longitudinal groove 3 in the column 1 and the lateral longitudinal groove 3 in the movable arm 11, this groove 3 in the column 1 forming a slideway for a curtain supporting lower end rod 25 (FIGS. 2 and 3) of a curtain 27 (FIG. 1) when the curtain is to be extended and moved to the bottom of its path along the column 1 into the veranda curtain position while the groove 3 in the movable arm 11 constitutes a slideway for the lower end rod 25 of the curtain when the latter is to be moved to the bottom of its path along the arm 11 into the sunshade position.

The longitudinal grooves 3 in the column 1 and the movable arm 11 are provided at their ends with a labyrinth locking track 29 for locking the drawn curtain in position and facilitating its extraction for lifting. The labyrinth track 29 is shown on a larger scale in FIG. 5.

Figure 2:
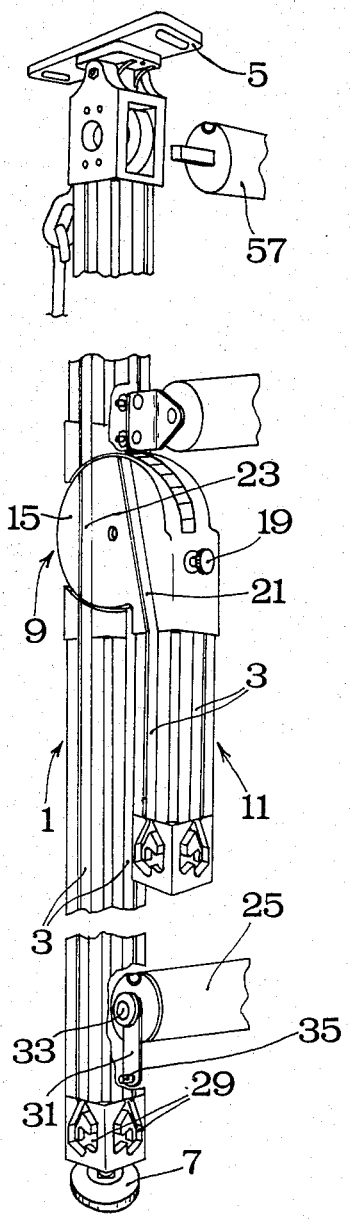
FIG. 2 is a perspective view, partially broken away, of the sunshade fitting according to the invention in the "veranda curtain" position.
Figure 3:
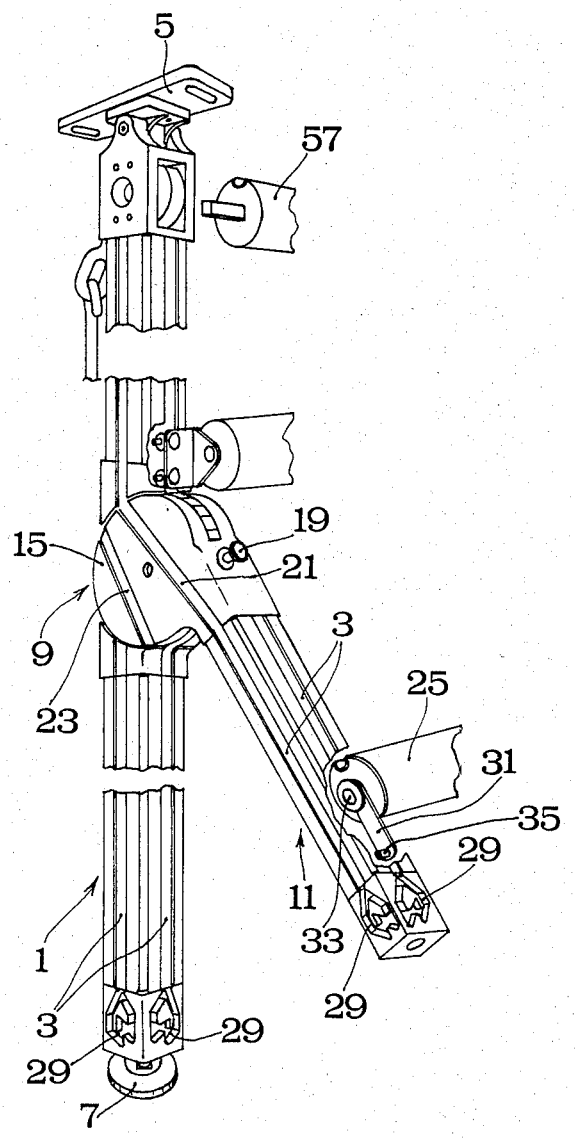
FIG. 3 is a view similar to FIG. 2, showing the fitting in the "sunshade" position.

As shown in FIGS. 2 and 3, for locking the curtain supporting lower end rod 25 in its end positions it is provided with a lever 31 freely pivotally mounted on the axis of rod 25 on a pivot 33 adapted to move along the grooves 3 in the column and the movable arm and carrying at its free end a pin 35 adapted to move along the labyrinth locking track 29. The movement of the pin 35 relative to the pivot 33 permits oscillation of the lever 31 when the pin 35 enters the labyrinth locking track 29, and causes locking of the lower end rod 25 in its seat at the end of travel. Similarly, when the curtain is lifted, the pin 35 moves along the opposite path of the labyrinth locking track 29 and permits unlocking of lower end rod 25. More precisely, as shown in FIG. 5, on lowering the curtain both in the "veranda" position and in the "sunshade" position, the pin 35 moves along a portion 37 of the labyrinth locking track 29 and is locked in a central recess 39. On unlocking the curtain, the pin 35 moves along a portion 41 of the labyrinth locking track 29 and is guided into the groove 3 in the column 1 or the arm 11.

The stop pin 19 shown on a larger scale in FIG. 6 deserves particular attention. This pin 19 substantially comprises a pin proper 43 provided with a knurled head 45 and accommodated in an appropriate seat formed by a sleeve 47 secured to the member 15. The sleeve 47 accommodates appropriate spring means, in the illustrated embodiment a coil spring 49, which urges against an appropriate seat on the pin 43 and pushes it outwardly of the sleeve 47. The upper end of the sleeve 47 terminates with a V-shaped portion 51 which upwardly carries a V-shaped notch 53 (FIG. 4) located perpendicularly thereto. Similarly the head 45 of the stop pin 19 is provided below its knurled peripheral surface with a V-shaped portion 55 extending with its vertex downwardly.

The coupling of these two appropriately shaped portions, i.e. the V-shaped portion 55 of the head 45 of the stop pin 43 and the upper V-shaped portion 51 of the sleeve 47, according to their reciprocal position causes the "lowered" position (FIG. 4) or the "lifted" position (FIG. 6) of the pin 43. So these two elements of the stop pin cooperate in cam fashion and the actuation of this cam is caused by rotation through 90° of the head 45 relative to the sleeve 47. In this manner the movable arm 11 is fixed at the desired height by the user according to the notch 17 engaged by the stop pin 19.

As shown in FIG. 1, the present sunshade fitting comprises at least three rollers, namely a first curtain winder roller 57 firmly secured to the supporting column 1 in the vicinity of its upper end, a curtain winder or supporting roller formed by the previously described lower end rod 25 secured to the free end of the curtain and forming the stiffening and locking element necessary for stably fixing the curtain in the desired "sunshade" or "veranda" position, and a third idle roller 59 slidably secured in the vicinity and above the pivot means 9 of the arm 11 in the front slideway grooves 3 of the supporting column 1. The third idle roller 59 lowers to a position above the pivot means 9 of the movable arm 11 when the curtain is lowered, and is lifted from that position when the curtain is lifted by the curtain stretching roller formed by the lower end rod 25, up to the end of its traveling path.

Although a preferred embodiment of the invention has thus been described in detail and illustrated in the accompanying drawings, it is to be understood that the invention is not limited to this precise embodiment and that numerous changes and modifications obvious to one skilled in the art may be made therein without departing from the scope of the invention as defined by the appended claims.

I claim:

1. A sunshade fitting convertible into a veranda curtain fitting comprising:

a supporting column made of an appropriately longitudinally grooved sectional member secured to the ceiling and floor of the terrace to which the curtain is to be applied, each of said columns being provided with an upper link member for connection to the ceiling by means of a plate with dowels and bolts, and a lower link member having an adjustable foot supported on the floor;

an arm forming a single body with the supporting column, but pivotally mounted relative thereto, to pivot about a center of rotation located at a suitable height in the vicinity of the middle or the medium third of said column;

a pivot means provided adjacent said arm for rotation in an appropriate seat and adapted to regulate by said rotation the height of the curtain supporting arm secured thereto, said pivot means being formed by coupling two members one of which is flat and firmly secured to the column and has a substantially circular profile projecting outwardly from said column and the other is firmly secured to said arm and fits said first member in the manner of a jaw and is adapted to rotate relative thereto, said first member being provided with a series of notches appropriately spaced along the periphery of said circular profile and defining the pitch of inclination of said movable arm, said second member being provided with a stop pin adapted to selectively engage one of said notches and being urged radially thereinto by spring means;

said pivot member firmly secured to said arm being laterally provided with at least two grooves adapted to be aligned alternately with a longitudinal groove provided laterally on said column, one groove forming a slideway for a curtain supporting lower end rod, when the curtain is to be extended along said arm in the sunshade position and the other groove forming a slideway for said curtain supporting lower end rod when said rod is to be moved downwardly to the end of said longitudinal groove in said column in the veranda curtain position;

said grooves in said column and arm being provided at their ends with a labyrinth locking track for locking the drawn curtain in position and facilitating its extraction for lifting;

said curtain supporting lower end rod being provided at its two ends with a lever member freely pivotally mounted on an appropriate pivot on the axis of said rod and adapted to move along said grooves in said column and arm, said pivot supporting at its free end another pivot adapted to move along said labyrinth track, the movability of said pivot arranged at the free end of said lever member permitting said curtain supporting lower end rod to be locked and unlocked for lowering and lifting the curtain.

2. A sunshade fitting convertible into a veranda curtain fitting, as claimed in claim 1, wherein said stop pin for locking said pivot means is accommodated in an appropriate seat firmly secured to said arm, said stop pin having a point and an end opposite said point provided with a knurled head and a portion tapering conically toward said point, a dihedral seat on said stop pin for receiving said conical portion when said stop pin is depressed, said dihedral seat terminating upwardly with a triangular recess arranged perpendicularly to the axis of said dihedron and adapted to receive said conically tapering portion of said knurled head of said stop pin when it is rotated through 90° relative to its locking position.

3. A sunshade fitting convertible into a veranda curtain fitting, as clained in claim 1, comprising at least three rollers including a first curtain winder roller firmly secured to said supporting column in the vicinity of an upper end thereof, a curtain winder and supporting end roller secured to a free end of said curtain and forming a stiffening and locking element necessary for stably fixing said curtain in the veranda and sunshade positions, and a third idle roller slidably secured in the vicinity and above said pivot means of the arm in said slideway grooves of said supporting column, said third idle roller being arranged to lower to a position above said pivot means of said arm when said curtain is lowered and to be lifted from said position when said curtain is lifted by said curtain winder and supporting end roller.

* * * * *

UNITED STATES PATENT OFFICE

CERTIFICATE OF CORRECTION

Patent No. 4,509,576 Dated April 9, 1985

Inventor(s) Giovanni Serafini

It is certified that error appears in the above-identified patent and that said Letters Patent are hereby corrected as shown below:

On the title page;

The name of the inventor shown as "Serafini Giovanni" should be --Giovanni Serafini--.

Signed and Sealed this

*Sixteenth* Day of *July 1985*

[SEAL]

*Attest:*

DONALD J. QUIGG

*Attesting Officer* *Acting Commissioner of Patents and Trademarks*